United States Patent [19]

Nakayama et al.

[11] 3,939,636

[45] Feb. 24, 1976

[54] MIXED YARN

[75] Inventors: Yuzaburo Nakayama; Akinori Yamamoto, both of Otsu; Tomohiko Asahara, Ehime; Masaharu Shimamura; Yoshizo Tsuda, both of Otsu; Keisuke Igawa, Obu; Mitsuhiro Okamoto, Nagoya, all of Japan

[73] Assignee: Toray Industries, Inc., Tokyo, Japan

[22] Filed: July 24, 1974

[21] Appl. No.: 491,273

[30] Foreign Application Priority Data

Aug. 24, 1973 Japan ..... 48-94347

[52] U.S. Cl. ..... 57/140 BY; 28/72.17; 57/140 J; 57/153; 260/78 R

[51] Int. Cl.[2] ..... D02G 3/24; D02G 1/18

[58] Field of Search ..... 57/157 R, 140 R, 140 J, 57/140 BY, 153, 164; 260/78 R, 78 A, 78 S; 161/169, 172, 173; 28/72.17, 75 R

[56] References Cited

UNITED STATES PATENTS

| | | | |
|---|---|---|---|
| 3,225,534 | 12/1965 | Knospe | 57/140 BY |
| 3,376,270 | 4/1968 | Ridgway | 260/78 R |
| 3,380,968 | 4/1968 | Ridgway | 260/78 R |
| 3,416,302 | 12/1968 | Knospe | 57/140 BY |
| 3,444,681 | 5/1969 | Reese | 57/140 BY |
| 3,505,165 | 4/1970 | Kubitzek et al. | 161/173 |
| 3,534,540 | 10/1970 | Collingwood et al. | 57/140 BY |
| 3,542,745 | 11/1970 | Snooks, Jr. | 260/78 R |

*Primary Examiner*—John Petrakes

[57] ABSTRACT

A mixed yarn having a uniform dyeability to an acid dye, which comprises at least two kinds of polyamide filaments differing in shrinkage, each consisting mainly of repeating units represented by the following general formula:

(n = 10 - 13)

11 Claims, 1 Drawing Figure

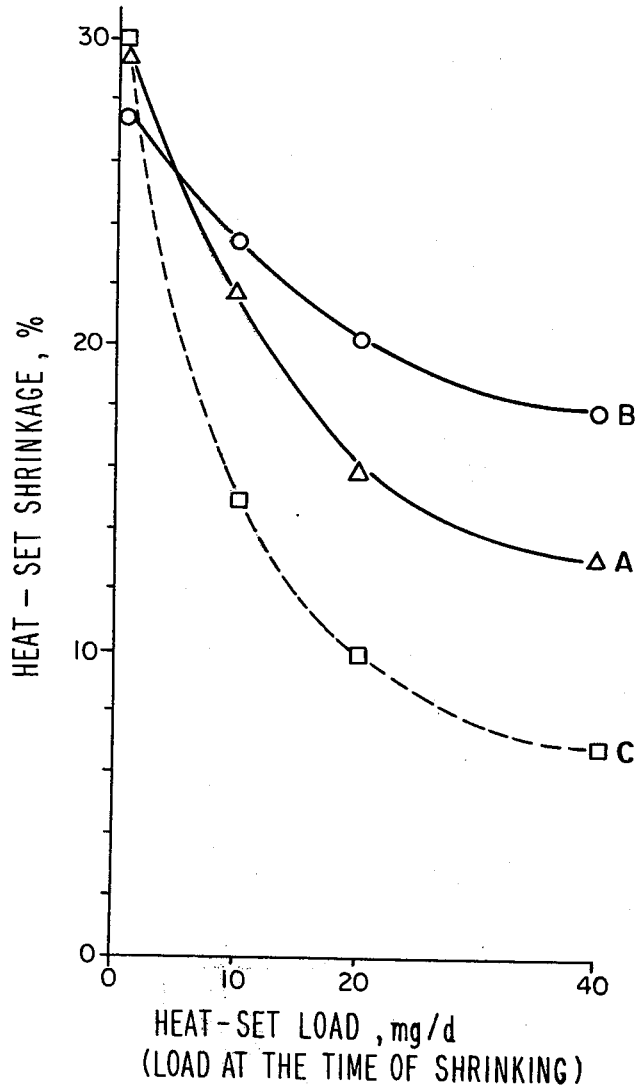
30
20
10
0
HEAT - SET SHRINKAGE, %
0
10
20
40
HEAT-SET LOAD, mg/d
(LOAD AT THE TIME OF SHRINKING)
B
A
C

MIXED YARN

BRIEF SUMMARY OF THE INVENTION

The present invention relates to a mixed yarn which comprises at least two kinds of polyamide filaments differing in shrinkage, each consisting mainly of repeating units represented by the general formula:

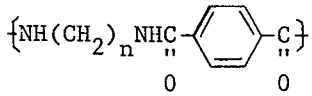

(n = 10 - 13)

and by making the content of an amino end group of a lower shrinkage filament larger than that of a higher shrinkage filament by $2 \times 10^{-5} - 8 \times 10^{-5}$ mole/g, and making the dyeability of said lower shrinkage filament substantially similar to that of said higher shrinkage filament, whereby it is possible to obtain a yarn which can be made into woven and knitted fabrics which are capable of dyeing free of dye uneveness.

The FIGURE is a graph which shows the influence of load on the heat-set shrinkage of a higher shrinkage yarn of the present invention, in which curve A represents data on a yarn of polymer composition: $11T/11I = 60/40$, curve B represents a yarn of polymer composition: $12T/12I = 60/40$ and curve C represents a yarn of polymer composition: *PACM*–12/*PACM*–*I* = 90/10. Curve C is shown in dash lines and represents a comparative example showing prior art as disclosed in Japanese Patent Publication No. 907/1969.

DETAILED DESCRIPTION OF THE INVENTION

The present invention relates to a mixed yarn having a uniform dyeability to an acid dye, which is composed of a plurality of components differing in shrinkage characteristics, such that the boil-off shrinkages of the components are not greatly different from each other. However, differences in heat-set shrinkages of the components at a temperature of at least 150° are larger than the difference in boil-off shrinkages of the components. More in particular, the invention relates to a mixed shrinkage yarn of the polyamide series which comprises at least two kinds of polyamide filaments which differ in shrinkage.

Lower Shrinkage Component

The lower shrinkage filament comprising a component of the mixed yarn of this invention consists of a composition containing units represented by the general formula:

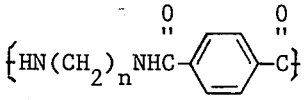

(1)

, wherein n is an intenger from 10 to 13 inclusive.

The amount of the units of that component, or the sum total of the amount of said units plus the amount of other isomorphous units, if required, is at least 75 mole %. In the carboxylic acid component in the polymer, the following relationship is satisfied:

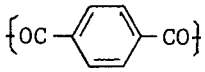

unit ≧ 40 mole %. (2)

In the diamine component in the polymer, the following relationship is satisfied;

$$+HN(CH_2)_nNH+ \text{ unit} \geqq 70 \text{ mole \%}. \quad (3)$$

Higher Shrinkage Component

The higher shrinkage filament also consists of a composition including a component represented by the general formula:

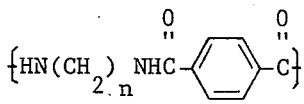

(4)

, where n is an integer from 10 to 13 inclusive.

The amount of such units, or the sum total of the amount of said units plus the amount of other isomorphous units, if required, is smaller than that of said lower shrinkage filament by at least 15 mole %. At least 20 mole % of non-isomorphous units is contained. In the carboxylic acid component in the polymer, the following relationship is satisfied:

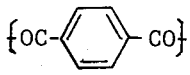

unit ≧ 40 mole %. (5)

In the diamine component in the polymer, the following relationship is satisfied:

$$+HN(CH_2)_nNH+ \text{ unit} \geqq 50 \text{mole \%}. \quad (6)$$

The general formulae (1) and (4) mean decamethylene terephtalamide in the case where *n* is 10 (hereinafter referred to as 10T), undecamethylene terephthalamide where n is 11 (hereinafter referred to as 11T), dodecamethylene terephthalamide where *n* is 12 (hereinafter referred to as 12T), and tridecamethylene terephthalamide where *n* is 13 (hereinafter referred to as 13T). Reference to isomorphous units means repeating units of a nylon salt of said diamine and a dicarboxylic acid which is isomorphous to terephthalic acid, such as adipic acid and hexahydroterephthalic acid, for example, undeca-methylene adipamide (hereinafter referred to as 11.6), dodecamethylene adipamide (hereinafter referred to as 12.6) and further like undecamethylene hexahydroterephthalamide (hereinafter referred to as 11TH) and dodecamethylene hexahydroterephthalamide (hereinafter referred to as 12TH). Calculation of the content of the non-isomorphous units referred to herein is considered with reference to diamine and dicarboxylic acid, respectively. With reference to diamine, calculation is made with respect to all the diamines other than decamethylene diamine, undecamethylene diamine, dodecamethylene diamine and tridecamethylene diamine and components other than dicarboxylic acid (for example, ω-amino acids, lactams). With reference to dicarboxylic acid, calculation is made with reference to all the dicarboxylic acids other than the aforesaid three kinds of dicarboxylic acids and the sum total of these calculated values is adopted. For example, in the case of 11T/11I (I is isophthalic acid) = 70/30, 30 mole % of isophthalic acid only is adopted, in the case of 11T/6.10 (6.10 is hexamethylene sebacamide)= 85/15, a sum total of hexamethylene diamine and sebacic acid, 15 + 15 = 30 mole % is adopted. In the case of 11T/12 (12 is laurolactam) = 80/20, 20 mole % of laurolactam only is adopted.

Attempts have been made to date to prepare woven and knitted fabrics having superior bulkiness by combining a plurality of filaments which differ in shrinkage. However, a so-called hydrophilic fiber having short repeating units normally has a boil-off shrinkage that is larger than the heat-set shrinkage and even if the bulking of a yarn develops by scouring (treatment with hot water), it has the drawback that the effect of bulking is decreased by heat-setting. Accordingly, it cannot be said that the final objective is achieved.

In contrast, reference is made to the disclosure in Japanese Patent Application Publication No. 907/1969, which is directed to the concept of enabling a fiber to be bulked by heat-setting, but which produces a fiber that is very unsatisfactory when subjected to such textile processing steps as dyeing and finishing.

Specifically, In Japanese Patent Publication No. 907/1969, para-aminocyclohexylmethane-dodecandioic acid (hereinafter referred to as PACM-12) is copolymerized with an amount of a non-isomorphous dicarboxylic acid (for example, 10 mole % of isophthalic acid hereinafter referred to as PACM-I) in order to obtain the higher shrinkage component. The resulting copolyamide filament has a large heat-set shrinkage. However, when the load at the time of shrinking is rather large, the value of the shrinkage sharply decreases.

In woven and knitted fabrics, the friction force among filaments is considerable. It is generally about 15 mg/d in some parts. Accordingly, in the case of a mixed yarn like the aforementioned yarn C, the influence of load on the heat-set shrinkage is considerable, the DFL (difference in filament length) necessary for development of the desired feel or "hand" varies slightly under different conditions. This becomes a major problem with regard to textile processing. The smaller the influence of load on the heat-set shrinkage, and the larger the shrinking stress, the less is the deviation from the desired DFL, and it is possible to develop the desired feel of "hand" with certainty and uniformity. Therefore, bulking is possible to a sufficient degree on the fabrics and textiles. In contrast, in a yarn, for example, of Japanese Patent Publication No. 907/1969, the influence of load is large, and uniform and reproducible bulking of the fabric and of other textile products is difficult to attain.

Description will be made hereinbelow especially with reference to shrinking characteristics of the conditions for obtaining woven and knitted fabrics having excellent feeling handle aimed at by the present invention. A DFL value for the fabric, after heat-setting of about 5 – 15% is appropriate. When this value is too high, the fiber tends to form loops. When the DFL value is less than 5%, bulkiness, hand and loft suffer.

Required shrinkages of the respective individual component yarns for providing such DFL values become as follows, in respect to boil-off shrinkage and heat-set shrinkage. At first, when the scouring of fabrics and textiles is considered, when the difference of shrinkages in treatment with boiling water is too large (for example, 50%), this tends toward the formation of crepe and causes trouble in high speed knitting and weaving processes. When the boil-off shrinkage at 98°C for 30 minutes is designated X and the higher shrinkage side and the lower shrinkage side are called H and L, respectively, the following conditions are necessary for processing fabrics and textiles:

$$X_H - X_L \leqq 10$$

more preferably $$X_H - X_L \leqq 7$$

and with respect to $X_H$ and $X_L$, respectively $$X_H < 20$$
$$X_L < 15$$

Concerning the heat-set shrinkage Y (under a load of 4 mg/d, 180°C/5 min) corresponding to a textile finishing process, when this value is excessively large, instability is developed with respect to fabric width and tension is developed in the heat-setting process.

Therefore, the upper limit is determined, and accordingly the difference in heat-set shrinkage of the two components should be larger than the difference of boil-off shrinkage of the two components. Therefore, it is necessary that $$50 > Y_H - Y_L \geqq 5$$
$$Y_H - Y_L > X_H - X_L$$

Ranges usable for the respective shrinkages of a single component yarn are as follows:

$$15 > X_H$$
$$20 > X_L$$
$$Y_H \geqq 15$$
$$10 \geqq X_H - X_L$$
$$50 > Y_H - Y_L \quad 5$$
$$Y_H - Y_L > X_H \geqq X_L$$

The present inventors have created a mixed yarn, the main units of which consist of 10T, 11T, 12T or 13T in accordance with the present invention as a result. Especially in a system of the higher shrinkage side, despite the fact that shrinkage is considerably larger because of the existence of non-isomorphous units, the mixed yarn has a Young's modulus of at least 40 – 50 g/d. Moreover, the influence of load on the heat-set shrinkage is small. To the extent of a load of 15 – 20 mg/d, shrinkage does not decrease drastically as compared with a case in which the load is zero. It is important that the dynamic properties of a higher shrinkage filament are so excellent. In a bulked-up mixed yarn, a higher shrinkage filament is distributed in the vicinity of the center of the multifilament, constituting its main resistance especially to tensile forces and dynamic deformation, and is effective for enhancing dimensional stability and firmness when such mixed yarn is made into a fabric or other textile product. The fact that the Young's modulus is high is a very advantageous factor. And in a bulking treatment using dry heat, the influence of load on shrinkage is small. Therefore, such yarn is easy to handle in textile processing.

With regard to the bulking treatment, the higher the temperature, the more effective it is. However, when the temperature is too high, the yarn deteriorates. Accordingly, a normal temperature range of 150° – 200 °C, especially 170° – 190°C is preferable.

A wide variety of polyamide materials may be used in the practice of the present invention.

It is important at first to consider crystallinity in the case of a material used for a lower shrinkage filament, for example, materials produced by copolymerization of 10.6, 11.6, 12.6 and 13.6 units. Further, copolymers of 10TH, 11TH, 12TH and 13TH units with 10T, 11T, 12T and 13T are considered, in which case the principle of isomorphous substitution is applicable and the crystallinity is hardly reduced at all. When it is difficult to design Young's modulus, glass transition point and melting point of the polymer and the dyeability thereof by copolymerization of these units only, it is preferable to introduce a small amount of another unit such as isophthalamide (nI) hexamethylene terephthalamide (6T), p-xylylene adipamide (PX·6) or p-xylylene terephthalamide (PX·T), however, because these units reduce crystallinity, the amount thereof introduced is preferably at most 25 mole %, more preferably at most 10 mole %. Besides these units, caprolactam (6), laurolactam (12) and other polyamide-forming monomers are properly used. However, it is preferable to use them in small amounts.

As polymers used as materials for the higher shrinkage filament, it is necessary that of the sum total of the amount of dicarboxylic acid and the amount of a derivative of carboxylic acid other than that (for example, ω-amino acid, lactam), terephthalic acid should constitute at least about 40 mole %, and of the diamine component, decamethylene diamine, undecamethylene diamine, dodecamethylene diamine or tridecamethylene diamine should similarly occupy at least about 50 mole %. However, because they are used as a higher shrinkage component together with the aforesaid lower shrinkage component, it is necessary to predetermine the amount of this 10T, 11T units or 12T, 13T units, or the sum total of said amount plus the amount of units isomorphous to said units, so as to be smaller than that of a lower shrinkage component by at least 15 mole % and said higher shrinkage component should contain at least 20 mole % of non-isomorphous units.

As a result of examining shrinkage characteristics and physical characteristics (glass transition point, Young's modulus, etc.) necessary for obtaining woven and knitted fabrics having superior bulk, voluminous feel, loft and hand, by heat-setting, we have found the aforementioned composition of polymers. These polymers are able to produce a product which is highly satisfactory in respect of touch. However, when such product is observed from the aesthetic viewpoint, it is inadequate because of a visual factor. However good the feeling, handle and surface touch a fabric may have, its commercial value is sharply reduced when it cannot be dyed to an attractive color.

It is preferable to dye a fabric with an acid dye to produce a dyed color of excellent clarity. The individual components of a mixed yarn must be dyed sufficiently. To that end, the value of the content of the amino end group should be greater than that of a conventional hydrophilic polyamide, which value is necessarily at least $5 \times 10^{-5}$ mole/g in the lower shrinkage component and at least $3 \times 10^{-5}$ mole/g in the higher shrinkage component. It is further found that when these two components are mixed, the difference in content of the amino end groups of the two is very important for the color and dyed evenness. Namely, it is found that when there is no difference in content of the amino end groups between the two components, the higher shrinkage component is dyed in a deeper color, becoming a dye unevenness, and when there is an extremely large difference in content of amino end groups between the two components, a similar dye unevenness is brought about. We have found that when said difference is within the range of $2 - 8 \times 10^{-5}$ mole/g as will be mentioned in the examples in this specification, this problem is solved.

When there is substantially no difference in dye absorption, dye unevenness is not found to exist. This judgment is carried out as follows. About 30 cm × 30 cm samples of woven and knitted fabrics are dyed, and the product is judged by the naked eye of an expert examiner highly skilled in the art.

Further, it is important that an amino end group adversely affects the heat resistance of a polymer. When the content of amino end groups in the polymer exceeds $15 \times 10^{-5}$ mole/g, the polymer has a tendency toward gellation, heat decomposition, coloration and soiling of the spinneret. When all of these factors are taken into account, the content of the amino end group becomes important.

In order to dye this polyamide more effectively, it is preferable to use a levelling acid dye or a semi-levelling acid dye having a small molecular weight, and to dye the polyamide at a dye bath pH of 2 – 4 and at a dyeing temperature of at least 90°C, preferably at least 120°C.

The yarn of the present invention produces a product which exhibits good luster, even when the cross-sectional configuration of the yarn is circular. However, in order to make the luster better (generally a silk-like luster is highly regarded), the cross-sectional configuration of the yarn may be non-circular such as trilobal, for example. It is preferable that the modification ratio of the cross-section of the yarn (ratio of the diameter of a circumscribed circle to that of an inscribed circle) be within the range of 1.3 – 1.9, and it is preferable that the modification ratio of the filament of the lower shrinkage component and the filament of the higher shrinkage component be the same, as much as possible.

In the practice of the present invention, known technology may be used for mixing the higher shrinkage filament with the lower shrinkage filament. For example, doubling two undrawn yarns obtained by separately spinning, and then drawing and intertwining filaments by a suitable treatment (for example, treatment with compressed air) may be used. Also, a method of obtaining a mixed yarn already mixed as undrawn yarns by carrying out so-called "co-spinning" using a special spinneret may be used. Other methods include opening separately drawn yarns and thereafter mixing the yarns. In the case of drawing co-spun undrawn yarns, it is necessary to make the difference in tension between respective components at the time of drawing within 0.1 g/d; when said difference exceeds this range, fluffing and partial loosening of the yarn are brought about, harming drawability and becoming a reason for difficulties in preparation, and spoiling the beautiful appearance of the final product.

It is desirable to determine the number of filaments and the single filament denier so that the ratio of the lower shrinkage filaments falls within the range of about 25 – 75% by weight, as the mix ratio of the two components. And the ratio of the number of filaments on the lower shrinkage side to the number of filaments on the higher shrinkage side should be in the range of about ¼ – 4/1. When said ratio is more or less than said range, it is difficult to obtain woven and knitted fabrics having the excellent feel and handle of the present invention.

In the mixed yarn of the present invention, fibers other than mentioned above may be mixed, if the quantity is limited so as not to obstruct the beneficial effects of the present invention. It is possible to blend, with the fiber of the present invention, suitable antistatic agents, heat stabilizers, light stabilizers, antioxidants, ultraviolet ray absorbing agents, delustrants and pigments. The mixed yarn of the present invention can increase the shrinkage difference of filaments without adversely affecting the characteristics of the filaments. Therefore, in the case of, for example, making a woven fabric from such yarn, it is possible to make the desired fabric without obstacle.

Hereinbelow, the present invention will be explained by reference to the following examples.

EXAMPLES 1 – 12

Selecting as a lower shrinkage component a copolyamide of the composition of $12T/12I = 85/15$ (% by weight), and adding as a polymerization degree stabilizer suitable amounts of benzoic acid and dodecamethylene diamine, conventional melt polymerization was carried out to obtain copolyamides differing in content of end groups as shown in Table 1.

Table 1

| Polymer No. | Analyzed value of polymer | | |
|---|---|---|---|
| | $\eta_T$ [a] | content of amino end group[b] | content of carboxyl end group[c] |
| | | $\times 10^{-5}$ mole/g | $\times 10^{-5}$ mole g |
| 1 | 2.18 | 13.1 | 0.3 |
| 2 | 2.23 | 9.7 | 0.4 |
| 3 | 2.09 | 7.2 | 1.2 |
| 4 | 2.17 | 6.0 | 1.2 |
| 5 | 2.20 | 5.1 | 1.4 |
| 6 | 2.21 | 3.2 | 3.1 |

Note:
[a]Relative solution viscosity (Conc.$H_2SO_4$, 1%, 25°C)
[b]Titrated with 1/50 N HCl using phenol/ethanol (80/20, % by weight) as a solvent (indicator: Thymol Blue)
[c]Titrated with 1/50 N KOH ethanol at 200°C using benzyl alcohol as a solvent (indicator: Phenolphthalein)

Next, as a higher shrinkage component, a copolyamide of the composition of $12T/12I = 60/40$ (% by weight) was selected in carrying out operations the same as mentioned above to obtain the copolyamides shown in Table 2.

Table 2

| Polymer No. | Analyzed value of polymer | | |
|---|---|---|---|
| | $\eta_T$ [a] | content of amino end group[b] | content of carboxyl end group[c] |
| | | $\times 10^{-5}$ mole/g | $\times 10^{-5}$ mole/g |
| 7 | 2.20 | 13.7 | 0.4 |
| 8 | 2.23 | 12.0 | 0.4 |
| 9 | 2.18 | 7.1 | 1.3 |
| 10 | 2.20 | 5.9 | 1.3 |
| 11 | 2.27 | 4.4 | 1.9 |
| 12 | 2.19 | 2.5 | 3.3 |

[a],[b],[c]are the same as in the footnote of Table 1.

These polymers were melt spun by conventional methods to obtain undrawn yarns, that were heat-drawn using a hot pin at 80°C and a hot plate at 150°C. The yarn properties of the drawn yarns are shown in Table 3. As comparison, the shrinkage properties of a higher shrinkage fiber disclosed in Japanese Patent Publication No. 907/1969 are also shown.

Table 3

| Polymer No. | Yarn properties of drawn yarn | | | | | | | |
|---|---|---|---|---|---|---|---|---|
| | Tenacity (g/d) | Elongation (%) | Young's modulus (g/d) | BOS[a] (%) | HSS [b] % | | | |
| | | | | | 1 | 4 | 10 | 20 mg/d |
| 1 | 3.7 | 25.1 | 48.7 | 3.9 | 7.9 | — | — | 7.2 |
| 2 | 4.7 | 30.7 | 49.2 | 4.1 | 7.3 | — | — | 6.7 |
| 3 | 4.2 | 33.4 | 48.1 | 4.2 | 8.1 | — | — | 7.7 |
| 4 | 4.7 | 31.5 | 49.6 | 3.8 | 7.5 | — | — | 7.2 |
| 5 | 5.1 | 30.6 | 50.2 | 4.1 | 7.7 | — | — | 7.3 |
| 6 | 5.2 | 29.8 | 50.4 | 4.7 | 8.1 | — | — | 7.6 |
| 7 | 3.9 | 26.1 | 47.3 | 8.9 | 20.6 | 19.1 | 18.7 | 15.2 |
| 8 | 4.6 | 35.2 | 48.2 | 8.3 | 19.2 | 18.7 | 18.1 | 15.4 |
| 9 | 4.3 | 36.2 | 49.1 | 8.5 | 18.7 | 17.6 | 17.1 | 14.3 |
| 10 | 4.4 | 35.1 | 50.1 | 8.2 | 18.5 | 18.0 | 17.6 | 14.4 |
| 11 | 4.6 | 34.3 | 48.1 | 8.6 | 19.1 | 18.0 | 17.3 | 15.0 |
| 12 | 4.7 | 33.1 | 49.1 | 8.4 | 18.9 | 17.5 | 17.1 | 14.7 |
| PACM-12/PACM-I = 90/10 | | | | | 30 | 25 | 15 | 10 |

Note:
[a]Boil-off shrinkage (treated in water at 98°C for 30 minutes).
[b]Heat-set shrinkage (treated under respective loads at 180°C for 5 minutes)

Polymers No. 1 and No. 7 soiled the spinneret and continuous spinning was difficult. The yarn properties of these drawn yarns meet the conditions concerning shrinkage described in the text of the specification.

Next, undrawn yarns of the lower shrinkage component shown in Table 1 and undrawn yarns of the higher shrinkage component shown in Table 2 were blended and simultaneously drawn. On the way of winding the blended yarns, the yarns were made to pass through a device blowing compressed air at a rate of 4 kg/cm² to mix or tangle the respective component yarns.

| Drawing conditions: | |
|---|---|
| Draw ratio | 3.5 times |
| Hot pin | 80°C |
| Hot saddle plate | 180°C |

The mixed yarns exhibited about the same yarn properties, that were as shown below.

| | |
|---|---|
| Tenacity | 4 – 5 g/d |
| Elongation | 30 – 38% |
| Young's modulus | 40 – 45 g/d |
| Boil-off shrinkage | 6 – 9% |
| Heat-set shrinkage | 17 – 21% |

Fabrics were woven using these mixed yarns. The fabrics became bulky and excellent feeling handle due to difference in shrinkage by heat setting at 180°C. Next the dyeability of these fabrics was examined. The results of dyeing fabrics composed of the mixed yarns of the respective combinations are shown in Table 4.

Table 4

| Combination of polymers | Content of amino end group: Lower shrinkage component | Content of amino end group: Higher shrinkage component | Difference in content of amino end groups[a] | Dyed results[b] | Ratio of Lower shrinkage component/ higher shrinkage component (wt %) |
|---|---|---|---|---|---|
| | $\times 10^{-5}$ mole/g | $\times 10^{-5}$ mole/g | $\times 10^{-5}$ mole/g | | |
| 2/8 | 9.7 | 12.0 | −2.3 | XX | 60/40 |
| 2/9 | 9.7 | 7.1 | 2.6 | 0 | 50/50 |
| 2/10 | 9.7 | 3.9 | 3.8 | 0 | 45/55 |
| 2/11 | 9.7 | 4.4 | 3.3 | 0 | 50/50 |
| 2/12 | 9.7 | 2.5 | 7.2 | X[c] | 60/40 |
| 3/9 | 7.2 | 7.1 | 0.1 | X[d] | 40/60 |
| 3/10 | 7.2 | 3.9 | 1.3 | X[d] | 70/30 |
| 3/11 | 7.2 | 4.4 | 2.8 | 0 | 50/50 |
| 4/11 | 6.0 | 4.4 | 1.6 | X[d] | 40/60 |
| 4/12 | 6.0 | 2.5 | 3.5 | X[c] | 60/40 |
| 5/11 | 5.1 | 4.4 | 0.7 | X[d] | 30/70 |
| 5/12 | 5.1 | 2.5 | 2.6 | X[c] | 35/65 |

Dyeing conditions:
Dye: C.I. Acid Orange 7 10% owf
Dye bath pH: 3
Dyeing time: 60 minutes
Temperature: 130° C

[a][Amino end group of a lower shrinkage component] − [amino end group of a higher shrinkage component]
[b]Dyed results:
0 Free of dye unevenness, dye uniformly
X Had dye unevenness
XX Remarkable dye unevenness
[c]The higher shrinkage component was not dyed in a deep color
[d]The higher shrinkage component was excessively dyed in a deep color As is apparent from Table 4, woven fabrics exhibiting uniform dyeability are obtained from respective polymers having the content of an amino end group within the range described herein.

EXAMPLES 13–26

By the same method as in Examples 1–12, as lower shrinkage components, copolyamides as shown in Table 5 were obtained.

Table 5

| Polymer No. | Composition of polymer | Analyzed value of polymer: $\eta_T$ [a] | content of amino end group[b] | content of carboxylic end group[c] |
|---|---|---|---|---|
| | | | $\times 10^{-5}$ mole/g | $\times 10^{-5}$ mole/g |
| 13 | 12T/12·6/6T = 50/40/10 | 2.20 | 7.3 | 1.1 |
| 14 | 12T/12·6/6T = 50/40/10 | 2.17 | 5.2 | 1.4 |
| 15 | 11T/11·I = 85/15 | 2.21 | 7.6 | 1.2 |
| 16 | 11T/11·I = 85/15 | 2.10 | 11.3 | 0.9 |
| 17 | 11T/11·I = 80/20 | 2.13 | 5.1 | 2.1 |
| 18 | 10T/10·I = 70/30 | 2.20 | 7.3 | 1.7 |
| 19 | 12T/11·I = 80/20 | 2.18 | 6.9 | 1.3 |

[a],[b],[c]were the same as the footnote of Table 1.

Next, as higher shrinkage components, copolyamides as shown in Table 6 were obtained.

Table 6

| Polymer No. | Composition of polymer | Analyzed value of polymer: $\eta_T$ [a] | content of amino end group[b] | content of carboxylic end group[c] |
|---|---|---|---|---|
| | | | $\times 10^{-5}$ mole/g | $\times 10^{-5}$ mole/g |
| 20 | 12T/12I = 55/45 | 2.20 | 4.7 | 2.2 |
| 21 | 12T/12I = 55/45 | 2.11 | 3.1 | 2.7 |
| 22 | 12T/12·10 = 65/35 | 2.20 | 5.1 | 1.8 |
| 23 | 11T/11I = 60/40 | 2.15 | 3.2 | 2.1 |
| 24 | 11T/11I = 60/40 | 2.16 | 4.7 | 1.9 |
| 25 | 10T/10I = 50/50 | 2.18 | 5.2 | 1.6 |
| 26 | 11T/12I = 60/40 | 2.21 | 4.2 | 1.3 |

[a],[b],[c]were the same as the footnotes of Table 1.

These polymers were melt spun using a conventional spinneret having orifices each having a Y-shape cross-sectional configuration to obtain undrawn yarns, that were heat-drawn using a hot pin at 70 – 90°C and a hot plate at 150 – 180°C. The drawn yarns had trilobal cross-sectional configurations, meeting the shrinking characteristics described in the text of the specification. Said drawn yarns consisting of a lower shrinkage component and a higher shrinking component were blended by the same method as in Examples 1–12 to obtain mixed yarns. Said mixed yarns consisting of any combination exhibited good physical properties and it can be expected that when such mixed yarns are woven or knitted into fabrics, such fabrics exhibit excellent feel and handle. When these yarns were dyed using the same dye and the same dyeing method as described in Examples 1–12, dyeability to acid dyes was as shown in Table 7 and it was understood that it was necessary to control the content of an amino end group in the yarn.

Table 7

| Combination of polymers | Content of amino end groups: Lower shrinkage component | Content of amino end groups: Higher shrinkage component | Difference in content of amino end groups[a] | Dyed results[b] | MR[c] | Ratio of lower shrinkage component/ higher shrinkage component (wt %) |
|---|---|---|---|---|---|---|
| | $\times 10^{-5}$ mole/g | $\times 10^{-5}$ mole/g | $\times 10^{-5}$ mole/g | | | |
| 13/20 | 7.3 | 4.7 | 2.6 | 0 | 1.5 | 50/50 |
| 13/22 | 7.3 | 5.1 | 2.2 | 0 | 1.6 | 45/55 |
| 14/20 | 5.2 | 4.7 | 0.5 | X[d] | 1.4 | 60/40 |
| 14/21 | 5.2 | 3.1 | 2.1 | 0 | 1.5 | 40/60 |
| 15/23 | 7.6 | 3.2 | 4.4 | 0 | 1.6 | 50/50 |
| 16/23 | 11.3 | 3.2 | 8.1 | X[c] | 1.8 | 70/30 |
| 16/24 | 11.3 | 4.7 | 6.6 | 0 | 1.5 | 60/40 |
| 17/23 | 5.1 | 3.2 | 1.9 | X[d] | 1.7 | 30/70 |
| 18/25 | 7.3 | 5.2 | 2.1 | 0 | 1.6 | 50/50 |
| 19/23 | 6.9 | 3.2 | 3.7 | 0 | 1.5 | 60/40 |
| 18/26 | 7.3 | 9.2 | 3.1 | 0 | 1.5 | 50/50 |

Dyeing conditions and (a), (b), (c), (d) were the same as the footnotes of Table 4.

Modification ratio: Ratio of the diameter of a circumscribed circle to that of an inscribed circle in cross sectional configuration of yarn.

EXAMPLE 27

As a lower shrinkage component, a copolymer of the composition of 11T/11.6/6T = 40/50/10 was obtained by a conventional melt polymerization method. The copolymer had an $\eta_T$ = 2.10 and a content of amino end groups of $7.6 \times 10^{-5}$ mole/g.

By a similar method, a higher shrinkage component, a copolymer of the composition 11T/11I/6T – 50/40/10 was obtained. This copolymer had an $\eta_T$ = 2.14 and a content amino end groups $4.3 \times 10^{-5}$ mole/g.

Using two kinds of copolymers, co-spinning was carried out.

| | |
|---|---|
| Spinning conditions: | |
| Spinning temperature: | 300°C |
| Spinneret having 18 × 2 = 36 T-shaped holes | |
| Mixing ratio: | 1 : 1 |
| Drawing conditions: | |
| Draw ratio: | 3.5 |
| Hot pin temperature: | 80°C |
| Hot saddle plate temperature: | 170°C |

The yarn properties of the mixed yarn so obtained were as follows.

| | |
|---|---|
| Denier: | 61 d |
| Tenacity: | 4.4 g/d |
| Elongation: | 35% |
| Young's modulus: | 40 g/d |

-continued

| | |
|---|---|
| Boil-off shrinkage: | 5.8% |
| Heat-set shrinkage: | 15.2% |
| Modification ratio: | 1.5 |

When this mixed yarn was woven into a fabric, scoured and bulked up by dry heat, a fabric having excellent feel and handle was prepared. This fabric was dyed with an acid dye and the product had a luster similar to that of silk, having excellent coloration and clearness. It was free of dye unevenness and possessed high merit as outerwear.

What is claimed is:

1. A mixed yarn having a uniform dyeability to an acid dye which comprises at least two kinds of polyamide filaments differing in shrinkage, characterized in that A. a lower shrinkage filament in which the amount of units each represented by the general formula

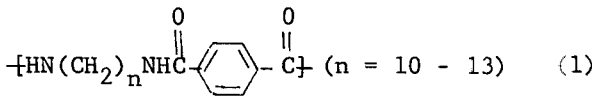

(1)

or the sum total of the amount of said units and the amount of other isomorphous units is at least 75 mole %, and in the carboxylic acid component in the polymer,

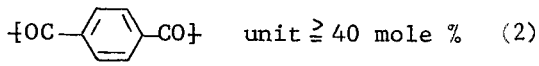

(2)

and in the diamine component in the polymer, $-HN(CH_2)_nNH-$ unit 70 mole % (3)

and, (B) a higher shrinkage filament in which the amount of units each represented by the general formula

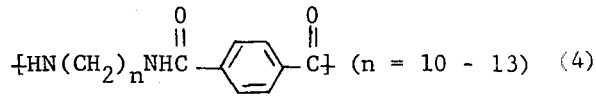

(4)

or the sum total of the amount of said units and the amount of other isomorphous units is smaller than that of said lower shrinkage filament by at least 15 mole % and at least 20 mole % of non-isomorphous units is contained, and wherein in the carboxylic acid component in the polymer,

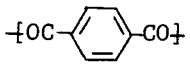

unit $\geqq$ 40 mole % (5)

and in the diamine component in the polymer, $-HN(CH_2)_nNH-$ unit 50 mole %, (6)

wherein the content of amino end groups in the lower shrinkage polymer is about $5 \times 10^{-5} - 12 \times 10^{-5}$ mole/g, said content in the higher shrinkage polymer is about $3 \times 10^{-5} - 10 \times 10^{-5}$ mole/g and the content of amino end group in the lower shrinkage filament is larger than that in the higher shrinkage filament by about $2 \times 10^{-5} - 8 \times 10^{-5}$ mole/g.

2. A mixed yarn according to claim 1, wherein in the general formulae (1) and (3) in the polymer in said lower shrinkage filament and in the general formulae (4) and (6) in the polymer in said higher shrinkage filament, each symbol $\eta$ is selected from 11 or 12 respectively.

3. A mixed yarn according to claim 1, wherein in the general formulae (1) and (3) in the polymer in said lower shrinkage filament and in the general formulae (4) and (6) in the polymer in said higher shrinkage filament, the symbol $\eta$ is 11.

4. A mixed yarn according to claim 1, wherein in the general formulae (1) and (3) in the polymer in said lower shrinkage filament and in the general formulae (4) and (6) in the polymer in said higher shrinkage filament, the symbol $\eta$ is 12.

5. A mixed yarn according to claim 1, wherein the difference in filament length (DFL) when the mixed yarn is heat-set under the load of 20 mg/d at 180°C for 5 minutes is at least about 5%.

6. A mixed yarn according to claim 1, wherein the cross sectional configuration of the yarn consisting of said mixed yarn is non-circular.

7. A mixed yarn according to claim 6, wherein the cross-sectional configuration of the filament yarn is trilobal.

8. A mixed yarn according to claim 6, wherein the modification ratio (ratio of the diameter of a circumscribed circle to that of an inscribed circle in the cross-sectional configuration of the yarn) is within the range of about 1.3 – 1.9.

9. A mixed yarn according to claim 1, wherein the content of said lower shrinkage filament is within the range of about 25 – 75% by weight.

10. A mixed yarn according to claim 1, dyed with an acid dye having substantially no difference of dye absorption.

11. A knitted or woven fabric consisting of a mixed yarn according to claim 1, dyed with an acid dye having substantially no difference of dye absorption.

* * * * *